US009708146B2

(12) United States Patent
Kumagai

(10) Patent No.: US 9,708,146 B2
(45) Date of Patent: Jul. 18, 2017

(54) MULTI-FEED DETECTION DEVICE, AND SHEET-SHAPED-OBJECT HANDLING DEVICE

(75) Inventor: Hideharu Kumagai, Higashiosaka (JP)

(73) Assignee: SIMOTEC CO., LTD., Osaka (JP)

( * ) Notice: Subject to any disclaimer, the term of this patent is extended or adjusted under 35 U.S.C. 154(b) by 0 days.

(21) Appl. No.: 14/410,363

(22) PCT Filed: Jun. 22, 2012

(86) PCT No.: PCT/JP2012/066066

§ 371 (c)(1),
(2), (4) Date: Dec. 22, 2014

(87) PCT Pub. No.: WO2013/190701

PCT Pub. Date: Dec. 27, 2013

(65) Prior Publication Data

US 2015/0336757 A1 Nov. 26, 2015

(51) Int. Cl.

| | |
|---|---|
| ***B65H 7/12*** | (2006.01) |
| ***B65H 7/20*** | (2006.01) |
| ***B65H 3/02*** | (2006.01) |

(52) U.S. Cl.

CPC ..... *B65H 7/12* (2013.01); *B65H 3/02* (2013.01); *B65H 7/20* (2013.01); *B65H 2220/03* (2013.01);

(Continued)

(58) Field of Classification Search

CPC . B65H 7/02; B65H 7/12; B65H 7/125; B65H 7/06; B65H 3/02; B65H 7/20;

(Continued)

(56) References Cited

U.S. PATENT DOCUMENTS

| | | | | |
|---|---|---|---|---|
| 5,662,324 | A * | 9/1997 | Cannaverde et al. | 271/263 |
| 6,203,084 | B1 * | 3/2001 | Kruk et al. | 294/104 |
| 6,224,053 | B1 * | 5/2001 | Bischke et al. | 271/265.03 |
| 2009/0057995 | A1 * | 3/2009 | Murakami et al. | 271/262 |

FOREIGN PATENT DOCUMENTS

| | | | |
|---|---|---|---|
| CN | 1039299 | A | 1/1990 |
| JP | 502833 | Y1 | 1/1975 |

(Continued)

OTHER PUBLICATIONS

Machine translation of JP8-336691.*

(Continued)

*Primary Examiner* — Thomas Morrison
(74) *Attorney, Agent, or Firm* — Cantor Colburn LLP

(57) ABSTRACT

A multi-feed detection device is provided with: a base; an arm rotatably supported on the base; a magnet affixed to the arm; a Hall element which is affixed to the base, and which outputs an electric signal corresponding to the strength of the magnetic field; a differentiation circuit which outputs a voltage corresponding to the differential value of the output of the Hall element; and an integration circuit which outputs a voltage corresponding to the integral value of the output of the differentiation circuit. The arm applies a force against a conveyance path by way of a spring. One or more sheets of paper conveyed on the conveyance path raise the arm, separating the magnet from the Hall element. Accordingly, the output of the integration circuit varies, and the number of sheets of paper is detected on the basis of this variation.

7 Claims, 9 Drawing Sheets

(52) U.S. Cl.
CPC .. *B65H 2511/214* (2013.01); *B65H 2511/524* (2013.01); *B65H 2553/22* (2013.01); *B65H 2553/612* (2013.01); *B65H 2701/1912* (2013.01)

(58) Field of Classification Search
CPC ..... B65H 2220/03; B65H 2511/214; B65H 2511/524; B65H 2553/22; B65H 2553/612; B65H 2701/1912
USPC ..... 271/262, 263, 265.04
See application file for complete search history.

(56) References Cited

FOREIGN PATENT DOCUMENTS

| | | | |
|---|---|---|---|
| JP | H01263505 | A | 10/1989 |
| JP | H07179247 | A | 7/1995 |
| JP | H08336691 | A | 12/1996 |
| JP | 2004352443 | A | 12/2004 |
| JP | 2011184124 | A | 9/2011 |

OTHER PUBLICATIONS

Notice of Reasons for Refusal for corresponding Japanese Application No. JP2014-521186; Dated: Jun. 16, 2015, with English translation.
International Search Report corresponding to Application No. PCT/JP2012/066066; Date of Mailing: Jul. 17, 2012, with English translation.
Partial English translation of JPS50-2833U, Japanese Utility Model Patent Application published Jan. 25, 1975.
Chinese First Office Action corresponding to Application No. 201280074187.9; Mailed on Jan. 4, 2016, with English translation.
Taiwanese Office Action corresponding to Application No. 102121954; Received: Jul. 13, 2016, with English Translation.

* cited by examiner

MULTI-FEED DETECTION DEVICE, AND SHEET-SHAPED-OBJECT HANDLING DEVICE

CROSS REFERENCE TO RELATED APPLICATIONS

This is the U.S. national stage of application No. PCT/JP2012/066066, filed on Jun. 22, 2012.

TECHNICAL FIELD

The present invention relates to a device detecting whether a sheet-shaped object conveyed along a conveyance path is plural and overlapped with each other or not.

BACKGROUND ART

Conventionally, an art measuring a thickness of a sheet-shaped object conveyed along a conveyance path with a magnetic sensor is known. For example, arts described in the Patent Literatures 1 and 2 are so.

The art measuring the thickness of the sheet-shaped object conveyed along the conveyance path can be applied to an art detecting whether the sheet-shaped object is plural and overlapped with each other or not on the basis of the measured thickness of the sheet-shaped object.

Each of devices described in the Patent Literatures 1 and 2 has an arm one of whose ends is supported rotatably, a roller rotatably pivoted on the arm and contacting the sheet-shaped object conveyed along the conveyance path, a permanent magnet fixed to the arm, and a magnetic sensor arranged at a position opposite to the permanent magnet (a position at which a magnetic field generated by the permanent magnet can be detected).

According to the devices described in the Patent Literatures 1 and 2, when the thickness of the sheet-shaped object conveyed along the conveyance path is changed, the arm is rotated so as to maintain the state that the roller contacts the sheet-shaped object, and the permanent magnet fixed to the arm is moved relatively to the magnetic sensor. As a result, by changing a distance from the permanent magnet to the magnetic sensor, a magnetic field (magnetic flux density) acting to the magnetic sensor is changed.

The magnetic sensor outputs an electric signal of voltage corresponding to strength of the magnetic field (magnitude of the magnetic flux density) acting to the magnetic sensor.

According to the devices described in the Patent Literatures 1 and 2, as a method improving measurement accuracy (more strictly speaking, measurement accuracy of the thickness of the sheet-shaped object or measurement accuracy of whether the sheet-shaped object is plural and overlapped with each other or not), following methods (1) to (3) can be considered generally.

(1) By increasing "moving distance of the permanent magnet per unit rotation angle of the arm", "change amount of the magnetic field acting to the magnetic sensor" per the moving distance of the permanent is increased.

(2) By selecting the permanent magnet which can generate the larger magnetic field, "the change amount of the magnetic field acting to the magnetic sensor" per the moving distance of the permanent is increased.

(3) By selecting the magnetic sensor with higher sensitivity, detection of slight change of the magnetic field is enabled.

However, in the case of (1), a full length of the arm becomes long, whereby the whole device is enlarged.

In the case of (2), the permanent magnet which can generate the stronger magnetic field (magnetic flux density) is generally more expensive than the magnet which spreads widely, whereby production cost of the device is increased.

In the case of (3), the magnetic sensor with the high sensitivity is generally expensive, whereby the production cost of the device is increased.

The strength of the magnetic field (the magnitude of the magnetic flux density) generated by one (single) magnet is decreased suddenly as the distance from the permanent magnet is increased, whereby the change of the magnetic flux density per the moving distance can be increased only in the case that the permanent magnet is arranged very near the magnetic sensor.

On the other hand, an art that the thickness of the sheet-shaped object conveyed along the conveyance path is measured in a non-contact state with an ultrasonic wave sensor is known. However, such an ultrasonic wave sensor is expensive and causes increase of the production cost.

PRIOR ART REFERENCE

Patent Literature

Patent Literature 1: the Japanese Patent Laid Open Gazette Hei. 7-179247

Patent Literature 2: the Japanese Patent Laid Open Gazette Hei. 1-263505

DISCLOSURE OF INVENTION

Problems to be Solved by the Invention

The present invention is provided in consideration of the above problems.

The purpose of the present invention is to provide a multi-feed detection device which can improve measurement accuracy without remarkably enlarging the device and increasing production cost in comparison with the conventional art (a device having one arm, one permanent magnet and one magnetic sensor, and a device with an ultrasonic wave sensor).

Means for Solving the Problems

An explanation will be given on means for solving the problems.

According to claim 1, a multi-feed detection device which judges whether a sheet-shaped-object, which has a pair of sheet surfaces and is conveyed along a conveyance path toward a conveying direction set previously, is the one sheet-shaped object or the plurality of the overlapped sheet-shaped objects, includes a base member fixed to a detection position which is in a middle part of the conveyance path and is opposite to the sheet-shaped object conveyed along the conveyance path, an arm member which has a contact part contacting one of the sheet surfaces of the sheet-shaped object conveyed along the conveyance path, is supported rotatably by the base member, and is applied thereto with biasing force so as to be rotated for making the contact part approach the conveyance path, wherein the contact part contacts the one of the sheet surfaces of the sheet-shaped object conveyed along the conveyance path so that the arm member is rotated so as to make the contact part approach or be separated from the conveyance path oppositely to the biasing force, a magnet fixed to the arm member and moved following the rotation of the arm member, a magnetic sensor which is fixed to a position opposite to the magnet in the base member and outputs an electric signal corresponding to a magnetic field changed by the movement of the magnet, a differentiation circuit which is connected to the magnetic sensor and outputs a differential electric signal corresponding to a differential value of the electric signal outputted by the magnetic sensor, and an integration circuit which is connected to the differentiation circuit and outputs an integral electric signal corresponding to an integral value of the differential electric signal outputted by the differentiation circuit. The arm member is formed by a circular member which is bent fan-like when viewed in an axial direction of a rotation shaft, a center of the fan-like shape is rotatably supported by the base member, one of ends of an arc part of the fan-like shape is formed as the contact part, and the magnet is fixed to the other end of the arc part of the fan-like shape.

According to claim 2, a direction of the movement of the magnet at the time of the rotation of the arm member is in parallel to a direction of a magnetic flux line of the magnetic field generated on the magnet.

According to claim 3, when the base member is fixed to the detection position, an axial direction of a rotation shaft of the arm member concerning the base member is perpendicular to the conveying direction, and is in parallel to the pair of the sheet surfaces of the sheet-shaped-object conveyed along the conveyance path.

According to claim 4, a sheet-shaped-object handling device having the multi-feed detection device according to one of claims 1 to 3 is provided.

Effect of the Invention

The present invention brings effect of improving measurement accuracy without remarkably enlarging the device and increasing production cost in comparison with the conventional art.

DESCRIPTION OF NOTATIONS

Figure 1:
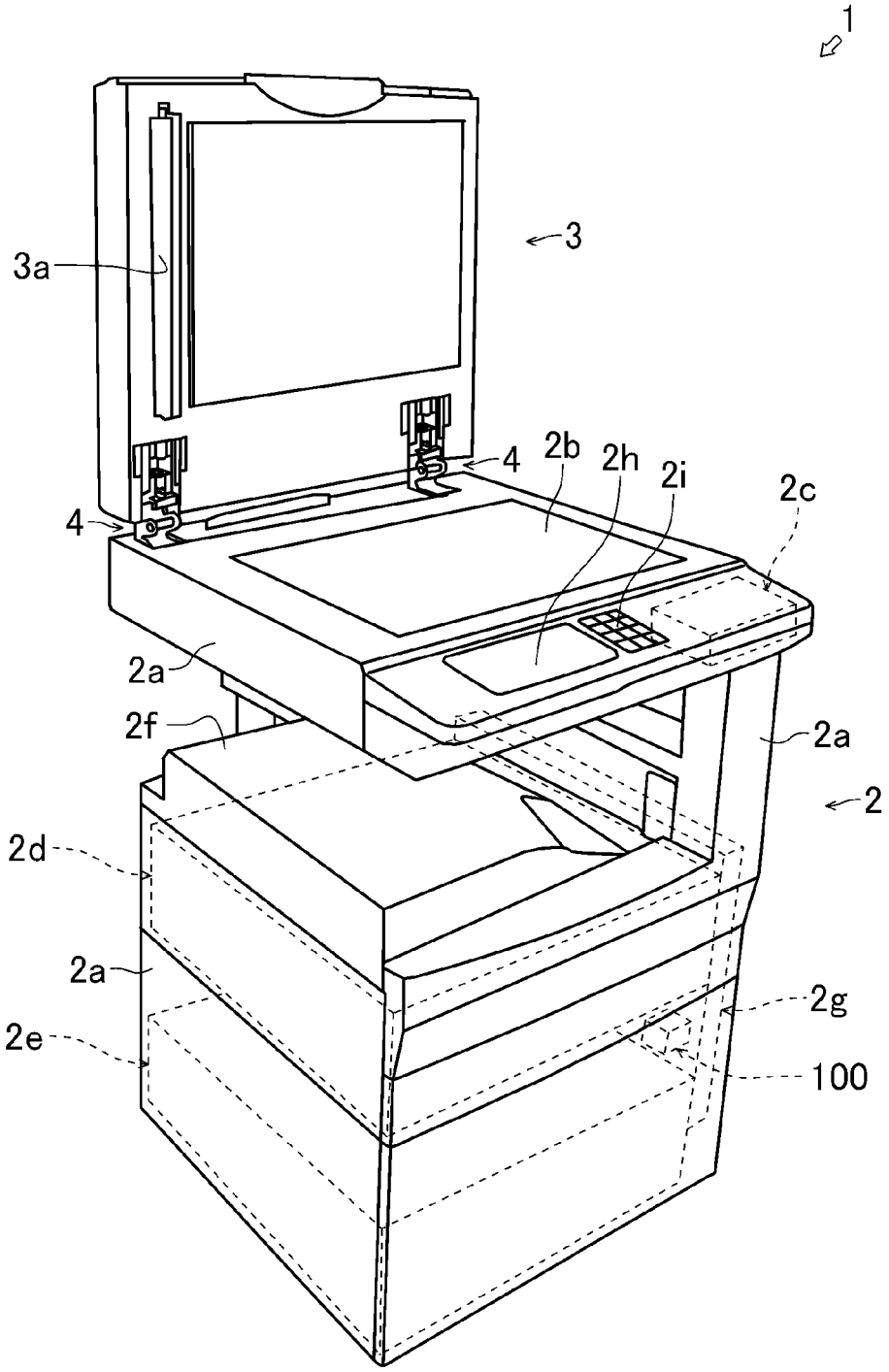
FIG. 1 is a perspective view of a composite machine having an embodiment of a multi-feed detection device according to the present invention.

1 composite machine
7 paper (an embodiment of a sheet-shaped object)
10 base (base member)
20 arm (arm member)
21 contact part
22 main body part
23 rotation shaft
32 magnet
33 spring (biasing force application member)
60 sensor unit
61 substrate
62 Hall element (magnetic sensor)
63 connector
64 differentiation circuit
65 integration circuit
100 multi-feed detection device

DETAILED DESCRIPTION OF THE INVENTION

[Composite Machine 1]

An explanation will be given on a composite machine 1 having a multi-feed detection device 100 which is an embodiment of a multi-feed detection device according to the present invention referring to FIGS. 1 to 5.

The composite machine 1 is an embodiment of a sheet-shaped object handling apparatus having the multi-feed detection device according to the present invention.

The "sheet-shaped object" means an article having a shape in which thickness is smaller than length and width.

A material constituting the sheet-shaped object may be a metal material, a resin material, fiber (natural fiber and synthetic fiber), the other materials and combination thereof.

As a concrete example of the sheet-shaped object, paper, cloth, film of resin, metal foil, a metal plate, a wood plate, a resin plate and the like are given.

The sheet-shaped object has a pair of sheet surfaces. "The pair of the sheet surfaces" means a pair of surfaces perpendicular to the thickness direction among outer surfaces of the sheet-shaped object.

When the sheet-shaped object is printing paper, a pair of surfaces constituting printing surfaces (front and back surfaces) of the printing paper is equivalent to the pair of the sheet surfaces.

The thickness of the sheet-shaped object which is a standard of the sheet-shaped object (standard thickness) is set previously. Even if variation of the thickness (difference from the standard) of the plurality of the sheet-shaped object exists, the variation is not so large (enough smaller than the standard thickness of the sheet-shaped object).

The "sheet-shaped object handling apparatus" is not limited to the composite machine 1 of this embodiment and includes widely an apparatus having a function conveying the sheet-shaped object.

As an example of the "sheet-shaped object handling apparatus", an office equipment having a function for conveying at least one of a document or "printing paper for printing a copy of the document", an automated teller machine (ATM) having a function for conveying a bill, and the like are given.

As a concrete example of the office equipment, the following (a) to (d) and the like are given.

(a) a scanner having an auto document feeder (ADF) and having a function reading a document and a function transmitting information concerning the read document (hereinafter, referred to as picture information) to another equipment (for example, a personal computer).

(b) a fax having a function reading the document, a function transmitting the picture information via a communication line to another equipment, and a function printing out the picture information obtained from another equipment.

(c) a copying machine having a function reading the document and a function printing out information concerning the read document.

(d) a composite machine having the functions as the scanner, the fax and the copying machine.

As shown in FIG. 1, the composite machine 1 has a composite machine body 2, a document pressing plate 3, two hinges 4 and the multi-feed detection device 100.

The composite machine body 2 has a body casing 2*a*, a document reading device 2*b*, a body side control device 2*c*, a printing device 2*d*, a paper supply device 2*e*, a tray 2*f*, a conveyance path 2*g*, a display device 2*h*, and an input device 2*i*.

The body casing 2*a* houses the other members constituting the composite machine body 2.

Generously, the body casing 2*a* of this embodiment has an upper casing, a lower casing and a stay connecting them to each other. A lower end of the stay is fixed to an upper end of the lower casing, and a upper end of the stay is fixed to a lower end of the upper casing, whereby the upper casing is supported at a height for a length of the stay from an upper surface of the lower casing.

The document reading device 2*b* reads the document and is arranged in an upper surface of the upper casing (an upper surface of the composite machine body 2).

The body side control device 2*c* controls operation of the composite machine 1.

Substantively, the body side control device 2*c* includes a substrate in which a storage part including a ROM, a RAM or a register and a calculation part including a CPU, and is housed in the upper casing of the body casing 2*a*.

A program concerning the function as the scanner, a program concerning the function as the fax, a program concerning the function as the copying machine and the like are stored in the body side control device 2*c*, and operation of the document reading device 2*b*, the printing device 2*d*, the paper supply device 2*e* and the like is controlled on the basis of the programs.

Figure 5:
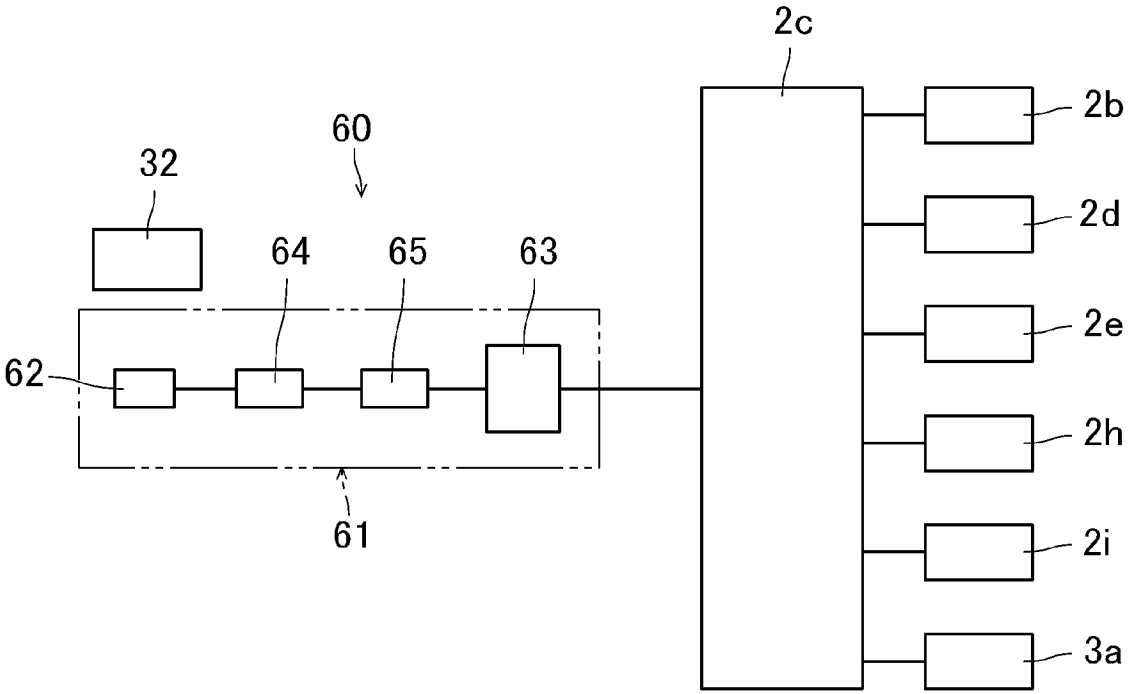
FIG. 5 is a block diagram of connection of the embodiment of the multi-feed detection device according to the present invention to each part of the composite machine having the multi-feed detection device.

As shown in FIG. 5, the body side control device 2*c* is connected to the document reading device 2*b*, and can obtain (receive) information concerning operation state of the document reading device 2*b* and picture information read by the document reading device 2*b* and can transmit a signal for making the document reading device 2*b* perform predetermined operation.

The picture information obtained from the document reading device 2*b* can be stored in the body side control device 2*c*.

The body side control device 2*c* is connected to a communication line (not shown) and can transmit the picture information stored in the body side control device 2*c* via the communication line to another equipment.

As shown in FIG. 5, the body side control device 2*c* is connected to the printing device 2*d*, and can obtain (receive) information concerning operation state of the printing device 2*d* and can transmit a signal for making the printing device 2*d* perform predetermined operation.

The printing device 2*d* prints picture on paper 7 (an embodiment of the sheet-shaped object according to the present invention) on the basis of the picture information stored in the body side control device 2*c*. The printing device 2*d* is housed in an upper half of the lower casing of the body casing 2*a*.

A plurality of sheets of the paper 7 are stored in the paper supply device 2*e* while being laminated, and the paper supply device 2*e* takes out the sheets of the paper 7 individually.

The paper supply device 2*e* is housed in a lower half of the lower casing of the body casing 2*a* (below the printing device 2*d*).

As shown in FIG. 5, the paper supply device 2*e* is connected to the body side control device 2*c*, and takes out the sheets of the paper 7 individually and supplies the paper 7 to the conveyance path 2*g* on the basis of a command signal received from the body side control device 2*c*.

The tray 2*f* receives the sheets of the paper 7 on which the picture is printed. In this embodiment, the tray 2*f* is formed in the upper surface of the lower casing.

The conveyance path 2*g* is an embodiment of a conveyance path according to the present invention.

The "conveyance path" is a path for conveying the sheet-shaped object along a conveying direction set previously.

As a concrete embodiment of the conveyance path, a rail-like member which has a conveying surface contacting one of the sheet surfaces of the sheet-shaped object and a pair of guide surfaces contacting a pair of end surfaces of the sheet-shaped object (a pair of end surfaces perpendicular to the conveying direction of the sheet-shaped object), a plurality of conveying rollers, each of which is rotated while contacting the sheet surface of the sheet-shaped object so as to convey the sheet-shaped object, aligned along the conveying direction, combination thereof and the like are given.

In this embodiment, the conveyance path 2*g* conveys the paper 7 taken out from the paper supply device 2*e* toward the printing device 2*d* (toward above the composite machine 1), and conveys the paper 7 on which the picture is printed in the printing device 2*d* toward the tray 2*f* (toward above the composite machine 1).

As shown in FIG. 5, the display device 2*h* is connected to the body side control device 2*c*, and displays information concerning operation state of the composite machine 1 obtained from the body side control device 2*c*.

In this embodiment, the display device 2*h* includes a liquid crystal display and is arranged in the upper surface of the upper casing of the body casing 2*a*.

As shown in FIG. 5, the input device 2*i* is connected to the body side control device 2*c*, and an operator inputs a command to the composite machine 1 and the like via the input device 2*i*.

In this embodiment, the input device 2*i* includes a plurality of switches and is arranged in the upper surface of the upper casing of the body casing 2*a*.

Though the display device 2*h* and the input device 2*i* are separated in this embodiment, these may alternatively be configured integrally with each other by using a touch panel for example.

The document pressing plate 3 presses (crimps) the document, which is mounted on the document reading device 2*b* arranged on the upper surface of the composite machine body 2, toward the document reading device 2*b* so as to prevent movement of the document (change of a position of the document relative to the document reading device 2*b*) at the time at which the document reading device 2*b* reads the document.

The document pressing plate 3 is arranged above the composite machine body 2 and rotatably connected to the composite machine body 2 via the hinges 4.

The document pressing plate 3 has an automatic document feeder 3*a*.

As shown in FIG. 5, the automatic document feeder 3*a* is connected to the body side control device 2*c*. On the basis of a command signal received from the body side control device 2*c*, the automatic document feeder 3*a* takes out the plurality of the documents, which are stored in an unread document storage tray (not shown) provided in an upper surface of the document pressing plate 3 while being laminated, individually and puts the documents on a reading position which is set on the document reading device 2*b*. After the document reading device 2*b* finishes the reading, the automatic document feeder 3*a* conveys the documents to a read document storage tray (not shown) provided in the upper surface of the document pressing plate 3.

An explanation will be given on the multi-feed detection device 100 which is the embodiment of the multi-feed detection device according to the present invention referring to the drawings.

[Multi-Feed Detection Device 100]

As shown in FIG. 1, the multi-feed detection device 100 is provided in a middle of the conveyance path 2*g*.

The multi-feed detection device 100 detects whether "the paper 7 conveyed toward the conveying direction set previously (in FIG. 1, upward) along the conveyance path 2*g*" is "the one sheet of the paper 7" or "the plurality of (two or more) overlapped sheets of the paper 7".

The "multi-feed" means that the plurality of the sheet-shaped object while being overlapped with each other.

The "conveying direction" means the direction toward which the sheet-shaped object is conveyed along the conveyance path 2*g*.

In below explanation and the drawings except for FIG. 1, for convenience, a "longitudinal direction" is defined by defining the direction toward which the paper 7 is conveyed (conveying direction) as a "rearward direction". A direction which is perpendicular to the longitudinal direction and is perpendicular to a conveying surface of the conveyance path 2*g* (a surface in parallel to the pair of the sheet surfaces of the paper 7 conveyed along the conveyance path 2*g*) is defined as a "vertical direction". A direction which is perpendicular to the longitudinal direction and is in parallel to the conveying surface of the conveyance path 2*g* (a direction which is perpendicular to the longitudinal direction and the vertical direction) is defined as a "lateral direction". Details of the multi-feed detection device 100 are explained using these defined directions.

The defined directions (the longitudinal direction, the vertical direction and the lateral direction) do not limit a posture at the time of usage of the multi-feed detection device according to the present invention. Namely, the posture at the time of usage of the multi-feed detection device according to the present invention may be different from the defined directions.

Figure 2:
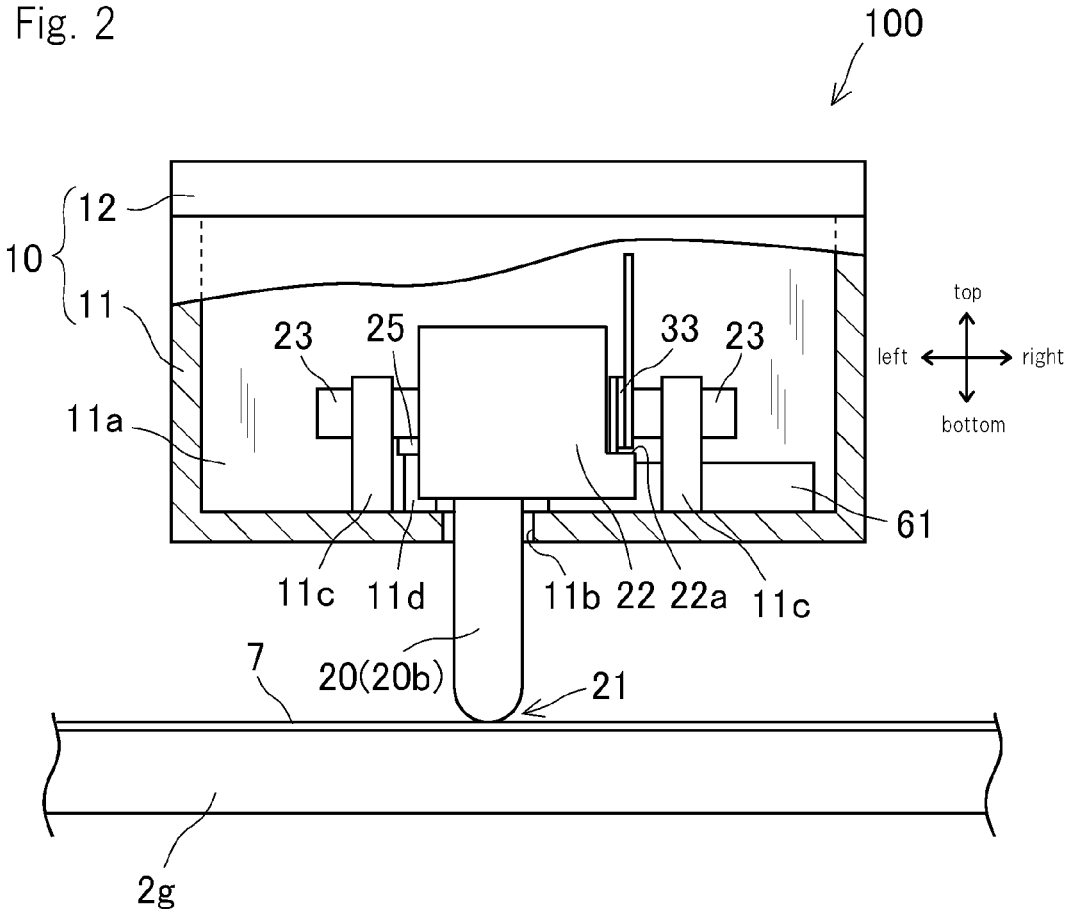
FIG. 2 is a front view partially in section of the embodiment of the multi-feed detection device according to the present invention.
Figure 3:
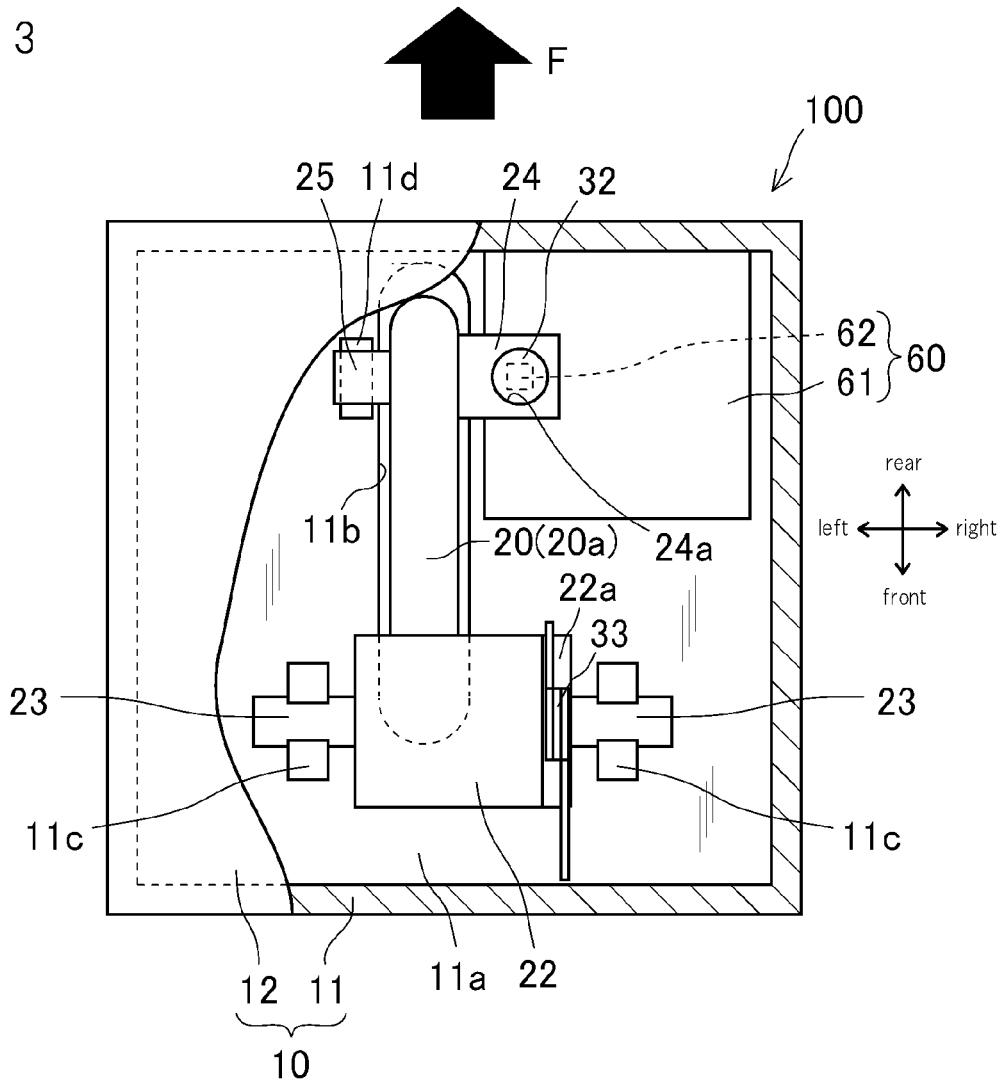
FIG. 3 is a plan view partially in section of the embodiment of the multi-feed detection device according to the present invention.
Figure 4:
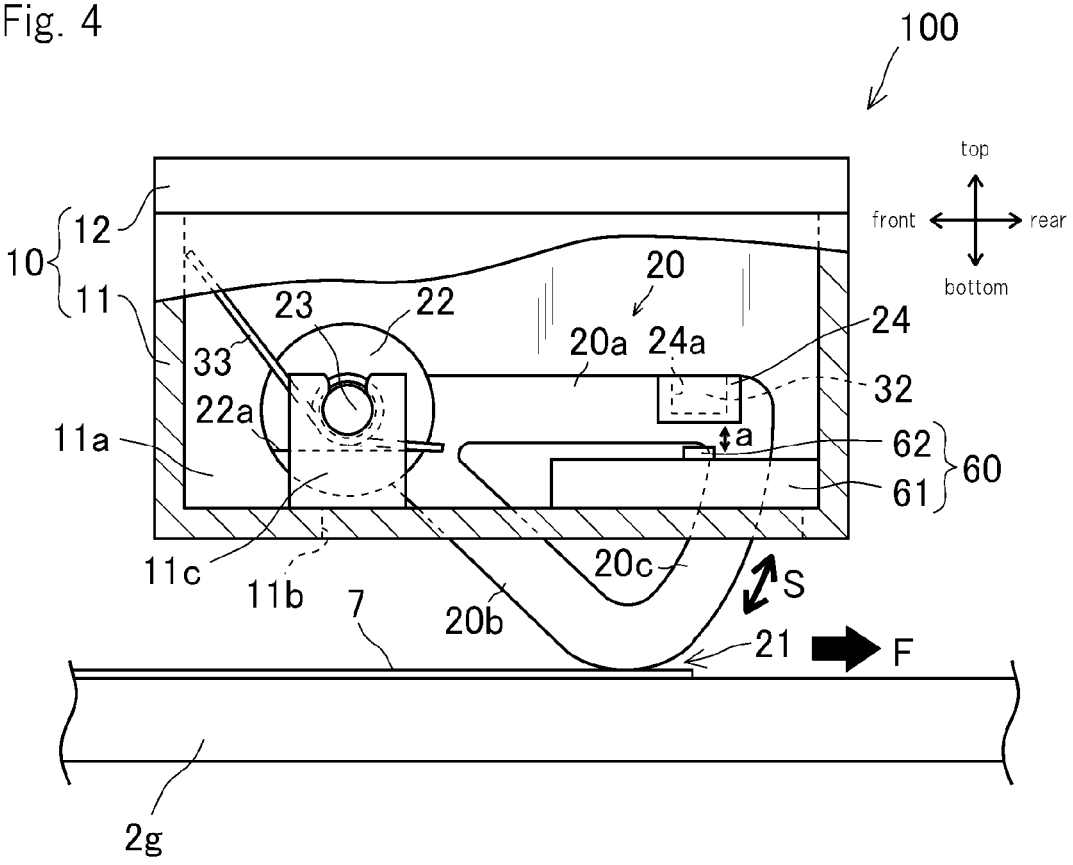
FIG. 4 is a right side view partially in section of the embodiment of the multi-feed detection device according to the present invention.

As shown in FIGS. 2 to 4, the multi-feed detection device 100 has a base 10, an arm 20, a main body part 22, rotation shafts 23, a magnet 32, a spring 33, a sensor unit 60 and the like as main components.

The base 10 is an embodiment of a base member according to the present invention and is a main structure of the multi-feed detection device 100.

In this embodiment, the base 10 includes a base body 11 and a base cover 12.

The base body 11 is shaped substantially square when viewed in plan, and is a substantially rectangular parallelepiped box-like member whose upper surface is opened. In this embodiment, the base body 11 is manufactured by forming a resin material.

In the base body 11, a housing chamber 11*a* is formed. The housing chamber 11*a* is a space formed inside the base body 11. The other members constituting the multi-feed detection device 100 is housed in the housing chamber 11*a*.

In a bottom surface of the base body 11, an opening groove 11*b* is formed for extending the arm 20. The opening groove 11*b* is formed as a long hole extended longitudinally in a lateral middle part of the bottom surface of the base body 11 so as to communicate the housing chamber 11*a* with the outside of the base body 11.

In a front part of the bottom surface of the base body 11, two support parts 11*c* which are projected upward are formed side by side. The support parts 11*c* support respectively the left and right rotation shafts 23 so as to make the arm 20 and the main body part 22 rotatable.

In the left of the opening groove 11*b* in a rear part of the bottom surface of the base body 11, a stopper 11*d* which is projected upward is formed. The stopper 11*d* contacts a rotation regulation part 25 formed in the arm 20 so as to regulate a rotation range of the arm 20 (concretely, a lower limit position in the rotation range of the arm 20).

The base cover 12 is a plate-like member which is shaped substantially square when viewed in plan and covers the opening of the upper surface of the base body 11. In this embodiment, the base cover 12 is manufactured by forming a resin material. The base cover 12 is fixed to the base body 11 with a fixation member (not shown) (for, example, a screw).

The arm 20 is an embodiment of an arm member according to the present invention.

As shown in FIG. 4, the arm 20 is a circular member which is bent fan-like when viewed in side. In more detail, in this embodiment, the arm 20 is formed circularly by a bar-like upper part 20*a* which is extended rearward, a bar-like lower part 20*b* which is integral with a front end of the upper part 20*a* and extended rearward downward, and an arc part 20*c* which connects rear ends of the upper part 20*a* and the lower part 20*b* to each other. In the arm 20, a curved part formed in a lower side of the connection part between the lower part 20*b* and the arc part 20*c* configures a contact part 21. The contact part 21 is an embodiment of a contact part according to the present invention.

The connection part between the upper part 20*a* and the lower part 20*b* in the arm 20 is connected integrally to the main body part 22. The main body part 22 is a substantially cylindrical member whose axis is arranged in the lateral direction. In other words, front ends of the upper part 20*a* and the lower part 20*b* are connected to the main body part 22 as a basal end of the arm 20, and the arc part 20*c* is extended rearward as a front end of the arm 20. As shown in FIG. 4, lower sides than middle parts of the lower part 20*b* and the arc part 20*c* are extended from the opening groove 11*b*. Namely, a lower part of the arm 20 is exposed outside the base body 11 and the contact part 21 is projected lower than a lower surface of the base 10.

The cylindrical rotation shafts 23 are extended from left and right bottom surfaces of the main body part 22. The rotation shafts 23 are an embodiment of a rotation shaft according to the present invention and constitute a rotation shaft of the arm 20 concerning the base 10. As mentioned above, the rotation shafts 23 are supported by the support parts 11*c* arranged in the bottom surface of the base body 11. Namely, by supporting the rotation shafts 23 by the support parts 11*c*, the arm 20 and the main body part 22 are arranged rotatably concerning the base body 11 as shown by an arrow S of FIG. 4. In this embodiment, when the arm 20 is supported concerning the base body 11 centering on the rotation shafts 23, an axial direction (lengthwise direction) of the rotation shafts 23 is in parallel to the lateral direction.

A plane part 22*a* is formed in a lower part of a right end of the main body part 22 so as to make an upper side thereof plane. The spring 33 which is a coil spring made by a metal material is interposed around the right rotation shaft 23. In detail, one of ends (upper end) of the spring 33 contacts an inner surface of the base body 11, and the other end (lower end) of the spring 33 contacts the plane part 22*a*. As shown in FIG. 4, by the spring 33 which is compressed, the main body part 22 is biased clockwise when viewed in right side. Namely, by biasing force of the spring 33, the arm 20 receives power for rotating downward (power for rotating clockwise when viewed in right side). "The biasing force applied on the arm 20 by the spring 33" is an embodiment of biasing force according to the present invention.

In a rear end of the upper part 20*a* of the arm 20, the rotation regulation part 25 which is projected leftward is formed. The rotation regulation part 25 contacts the stopper 11*d* arranged in the bottom surface of the base body 11 so as to regulate rotation of the arm 20. Namely, the rotation regulation part 25 contacts the stopper 11*d* while the arm 20 receives the power for rotating downward by the biasing force of the spring 33, whereby the arm 20 is not rotated downward from the position shown in FIG. 4. When the arm 20 receives upward power, the arm 20 is rotated upward (counterclockwise when viewed in right side) oppositely to the biasing force of the spring 33. When the upward power to the arm 20 is lost, the arm 20 is rotated downward (clockwise when viewed in right side) by the biasing force of the spring 33 and returns to the position (the position shown in FIG. 4) at which e rotation regulation part 25 contacts the stopper 11*d*.

In the rear end of the upper part 20*a* of the arm 20, a magnet arrangement part 24 is formed. In the magnet arrangement part 24, a magnet fixation hole 24*a* which is opened upward and has a bottom surface is formed.

The magnet 32 is an embodiment of a magnet according to the present invention.

The magnet 32 is a cylindrical permanent magnet having a pair of upper and lower end surfaces (upper end surface and lower end surface) and an outer peripheral surface.

The "permanent magnet" is an object which is magnetized spontaneously (without any magnetic field or current supplied from the outside) and generates a magnetic field around (as a result, generates magnetic power), and includes normally a ferromagnetic body.

As a concrete example of the permanent magnet, various magnets such as an alnico magnet, KS steel, MK steel, a ferrite magnet, a samarium cobalt magnet, a neodymium magnet and the like are given.

In this embodiment, the magnet 32 includes the neodymium magnet. The magnet 32 according to this embodiment is magnetized so as to make an upper end part (a part near an upper end surface) of the magnet 32 to be a N pole and make a lower end part (a part near a lower end surface) of the magnet 32 to be a S pole.

As shown in FIGS. 3 and 4, the magnet 32 is pushed into the magnet fixation hole 24*a* of the arm 20 and fixed at a position, at which the lower end surface of the magnet 32 contacts the bottom surface of the magnet fixation hole 24*a*, so as not to drop out from the magnet fixation hole 24*a*.

As shown in FIG. 5, the sensor unit 60 has a substrate 61, a Hall element 62, a differentiation circuit 64, an integration circuit 65 and a connector 63.

The substrate 61 has a pair of upper and lower plate surfaces and front, rear, left and right end surfaces, and is a plate-like member which is rectangular when viewed in plan. In this embodiment, the substrate 61 includes an insulation material (for example, insulation resin such as phenol resin or epoxy resin, and insulation ceramic such as silicon nitride or aluminum nitride), and circuit patterns constituting an electric paths are formed in the pair of upper and lower plate surfaces of the substrate 61.

The Hall element 62 is an embodiment of a magnetic sensor according to the present invention and outputs an electric signal corresponding to a magnetic field (strength of the magnetic field) acting on the Hall element 62.

In this embodiment, the Hall element 62 has a semiconductive film having a pair of film surfaces (upper and lower surfaces) and four end surfaces (front, rear, left and right surfaces), and four terminals including two input terminals and two output terminals which are connected respectively to the opposite side surfaces of the semiconductive film.

The two input terminals of the Hall element 62 are connected respectively to the front surface and the rear surface of the semiconductive film of the Hall element 62, and the two output terminals of the Hall element 62 are connected respectively to the left surface and the right surface of the semiconductive film of the Hall element 62.

When a magnetic field penetrating the front surface and the rear surface of the film of the Hall element 62 while voltage is applied to the two input terminals of the Hall element 62, potential difference (voltage) is generated between the two output terminals of the Hall element 62 corresponding to strength of the magnetic field by Hall effect.

In more detail, when the voltage (as a result, current) applied to the two input terminals of the Hall element 62 is fixed, the potential difference (voltage) generated between the two output terminals of the Hall element 62 corresponds substantially to magnitude of magnetic flux density (strength of the magnetic field) acting on the Hall element 62.

The Hall element 62 outputs the potential difference (voltage) generated between the two output terminals of the Hall element 62 as an electric signal. The Hall element 62 is fixed to a left end of the upper plate surface of the substrate 61 while the lower surface of the Hall element 62 is opposite to the upper plate surface of the substrate 61. The four terminals of the Hall element 62 are connected electrically to the circuit patterns, which are formed in the substrate 61, by soldering.

Instead of the Hall element 62 used in this embodiment, a magnetism responsive element such as a MR element may be used as the magnetic sensor.

The connector 63 connects an equipment of the outside and the like to the Hall element 62.

In this embodiment, the connector 63 has a box-like member and a plurality of connection pins.

The box-like member of the connector 63 is made by resin material, and an inner space is formed therein. An opening which communicates the inner space with the outside is formed in a right side surface of the box-like member.

The plurality of the connection pins of the connector 63 are arranged inside the box-like member of the connector 63, and basal ends of the plurality of the connection pins are supported by the box-like member of the connector 63.

The connector 63 is fixed to a right rear part of the upper plate surface of the substrate 61. When the connector 63 is fixed to the substrate 61, the basal ends of the plurality of the connection pins are connected electrically to the circuit patterns which are formed in the substrate 61, as a result the four terminals of the Hall element 62 by soldering.

The differentiation circuit 64 is fixed to the substrate 61, as a result the base 10. The differentiation circuit 64 is connected to the Hall element 62 and the integration circuit 65, and outputs voltage corresponding to a time differential value of the electric signal outputted by the Hall element 62 as a differential electric signal.

The integration circuit 65 is fixed to the substrate 61, as a result the base 10. The integration circuit 65 is connected to the differentiation circuit 64 and the connector 63, and outputs voltage corresponding to an integral value of the differentiation circuit 64 outputted by the differentiation circuit 64 as an integral electric signal.

The differentiation circuit 64 according to this embodiment is an active differentiation circuit having an operational amplifier, a resistor and a condenser. However, the present invention is not limited thereto.

As another embodiment of the differentiation circuit according to the present invention, a passive differentiation circuit such as a RC (resistor-capacitor) circuit is given.

A differential amplification circuit may be disposed collectively in the sensor unit 60.

As shown in FIGS. 2 to 4, the sensor unit 60 is housed in the housing chamber 11*a* of the base body 11 and the base cover 12 is fixed to the base body 11 so that the sensor unit 60 is fixed to the base 10.

Accordingly, position and posture of the sensor unit 60, as a result the Hall element 62 concerning the base 10 is held uniformly (the Hall element 62 is fixed to the base 10 so as not to be movable relatively and not to be rotatable relatively).

In the multi-feed detection device 100 according to this embodiment, the differentiation circuit 64 and the integration circuit 65 are fixed to the base 10. However, these members may alternatively be provided outside the base 10. Namely, it may alternatively be configured that the differentiation circuit 64 and the integration circuit 65 are disposed on a path from the base 10 to the body side control device 2*c*, and the output voltage of the Hall element 62 as the electric signal as it is and is exchanged into the differential electric signal and the integral electric signal in the path to the body side control device 2*c*. It may alternatively be configured that a function of the calculation procession of differentiation and integration as the above is added to a calculation part of the body side control device 2*c* of the composite machine body 2 and the electric signal outputted by the Hall element 62 is exchanged into the differential electric signal and the integral electric signal in the calculation part.

In this embodiment, one of ends of a wire is connected to the body side control device 2*c* and another connector (not shown) is provided in the other end of the wire and the connector is inserted into the opening of the box-like member of the connector 63 so that the Hall element 62 is connected via the connector 63 to the body side control device 2*c*.

The body side control device 2*c* supplies electric power for operating the Hall element 62 via the two input terminals of the Hall element 62 to the Hall element 62, and the Hall element 62 transmits the electric signal (the output voltage corresponding to the strength of the magnetic field acting on the Hall element 62) via the two output terminals of the Hall element 62 to the body side control device 2*c*.

In this embodiment, when the sensor unit 60 is fixed to the base 10 and the arm 20 to which the magnet 32 is fixed is supported rotatable relative to the base 10, the magnet 32 and the Hall element 62 are aligned along the vertical direction. Then, the Hall element 62 is arranged in an upward magnetic field (magnetic flux) in which a magnetic flux line is directed toward the S pole (lower end) of the magnet 32. When the arm 20 is rotated relatively to the base body 11, as shown in an arrow a in FIG. 4, the magnet 32 approaches and is separated from the Hall element 62. Accordingly, the magnetic field (strength of the magnetic field) acting on the Hall element 62 is changed and the electric signal corresponding to the change is outputted from the Hall element 62.

An explanation will be given on action of the multi-feed detection device 100 at the time of detecting "the paper 7 conveyed along the conveyance path 2*g*. As shown by arrows F in FIGS. 3 and 4, the paper 7 is conveyed rearward from the front side by the conveyance path 2*g*. In the body casing 2*a* of the composite machine body 2, the multi-feed detection device 100 is arranged at a position in the middle part of the conveyance path 2*g*, which conveys the paper 7 rearward, and opposite to the conveyance path 2*g* ("detection position" in this embodiment). "The position in the middle part of the conveyance path 2*g* and opposite to the conveyance path 2*g*" is an embodiment of the detection position according to the present invention.

When the multi-feed detection device 100 is fixed at the "detection position" in this embodiment, the axial direction of the rotation shafts 23 of the multi-feed detection device 100 (in this embodiment, the lateral direction) is perpendicular to the conveying direction (in this embodiment, the longitudinal direction).

When the multi-feed detection device 100 is fixed at the "detection position" in this embodiment, the axial direction of the rotation shafts 23 of the multi-feed detection device 100 (in this embodiment, the lateral direction) is in parallel to the conveying surface of the conveyance path 2*g* (in this embodiment, the surface which contacts the lower sheet surface of the pair of the sheet surfaces of the paper 7 when the paper 7 is conveyed along the conveyance path 2*g*, and is perpendicular to the vertical direction).

Then, the axial direction of the rotation shafts 23 of the multi-feed detection device 100 fixed at the "detection position" in this embodiment is in parallel to the pair of the sheet surfaces of the paper 7 conveyed along the conveyance path 2*g*.

The arm 20 of the multi-feed detection device 100 fixed at the "detection position" is biased by the spring 33 so as to be rotated along "a direction that the contact part 21 approaches the conveyance path 2*g* (clockwise when viewed in right side)".

Among directions of rotation of the arm 20, "the direction that the contact part 21 approaches the conveyance path 2*g* (clockwise when viewed in right side)" is an embodiment of an approaching direction according to the present invention.

Among directions of rotation of the arm 20, "the direction that the contact part 21 is separated from the conveyance path 2*g* (counterclockwise when viewed in right side)" is an embodiment of a separating direction according to the present invention.

As shown in FIG. 4, the paper 7 is conveyed rearward (along the arrow F in FIG. 4), and the front end of the paper 7 reaches below the contact part 21 of the arm 20. At this time, the contact part 21 contacts the upper sheet surface of the paper 7, and the arm 20 is rotated counterclockwise when viewed in right side (the separating direction in this embodiment) oppositely to the biasing force of the spring 33. As a result, the magnet 32 fixed to the arm 20 is moved upward, that is, separated from the Hall element 62.

When the magnet 32 fixed to the arm 20 is moved upward, a distance from the magnet 32 to the Hall element 62 is increased. As a result, the magnetic field which is generated on the magnet 32 and acts to the Hall element 62 becomes weak. Then, the Hall element 62 outputs the electric signal corresponding to the change of the magnetic field (strength of the magnetic field) acting on the Hall element 62 to the differentiation circuit 64.

Subsequently, the paper 7 is conveyed rearward further and the rear end of the paper 7 is separated below the contact part 21 of the arm 20. At this time, the contact part 21 is separated from the upper sheet surface of the paper 7, and the arm 20 is rotated clockwise when viewed in right side (the approaching direction in this embodiment) following the biasing force of the spring 33. As a result, the magnet 32 fixed to the arm 20 is moved downward, that is, approaches the Hall element 62.

When the magnet 32 fixed to the arm 20 is moved downward, the distance from the magnet 32 to the Hall element 62 is decreased. As a result, the magnetic field which is generated on the magnet 32 and acts to the Hall element 62 becomes strong. Then, the Hall element 62 outputs the electric signal corresponding to the change of the magnetic field (strength of the magnetic field) acting on the Hall element 62 to the differentiation circuit 64.

When the paper 7 is multi-fed, for example, when the two sheets of the paper 7 are conveyed while being overlapped, the contact part 21 contacts the upper sheet surface of the paper 7 and the arm 20 is rotated. Then, the distance of separation of the magnet 32 fixed to the arm 20 from the Hall element 62 is increased from that of the case of conveying the one sheet of the paper 7 for the overlap of the two sheets of the paper 7. Accordingly, the distance from the magnet 32 to the Hall element 62 becomes more than that of the case of the one sheet of the paper 7, and the magnetic field which is generated on the magnet 32 and acts to the Hall element 62 becomes weaker. Then, the Hall element 62 outputs the weaker electric signal corresponding to the change of the magnetic field (strength of the magnetic field) acting on the Hall element 62 to the differentiation circuit 64. Accordingly, by detecting the change of the electric signal outputted by the Hall element 62, the multi-feed detection device 100 detect whether the paper 7 (sheet-shaped object) is the one sheet or the plurality of the overlapped sheets.

An explanation will be given on the electric signal which is an output value of the multi-feed detection device 100 in more detail referring to FIG. 6(*a*) to (*c*). The case that the conveyance of the one sheet of the paper 7 is detected by the multi-feed detection device 100 and the case that the conveyance of the two overlapped sheets of the paper 7 is detected by the multi-feed detection device 100 are explained below.

Figure 6:
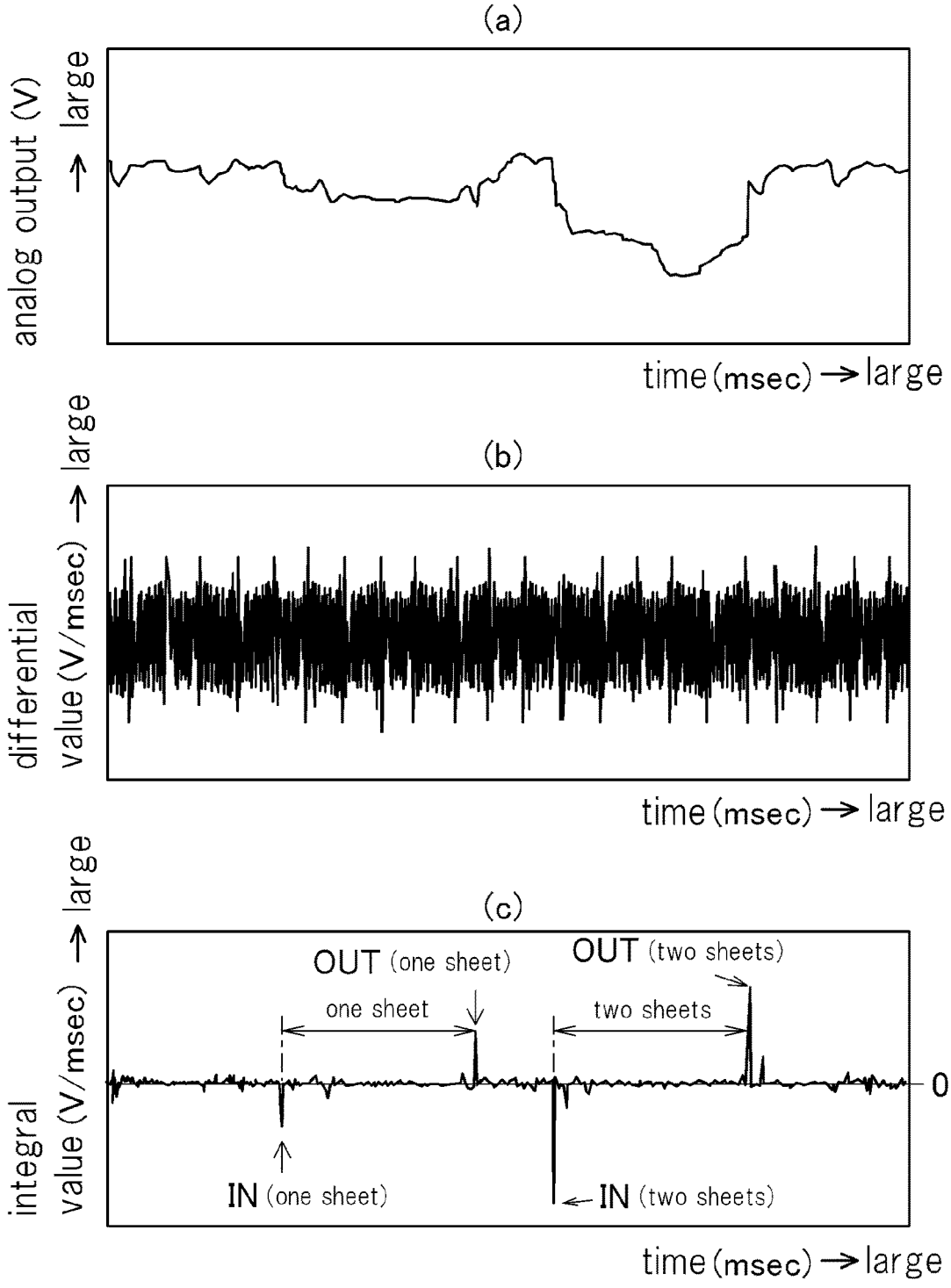
FIG. 6(*a*) is a diagram of an analog value of an electric signal outputted by a magnetic sensor, FIG. 6(*b*) is a diagram of a differential electric signal outputted by a differentiation circuit, and FIG. 6(*c*) is a diagram of an integral electric signal outputted by an integration circuit.

FIG. 6(*a*) is a diagram of an analog value of the electric signal outputted by the Hall element 62. Since the electric signal outputted by the Hall element 62 is a composition of a large surge and a small vibration generated in the conveyance path 2*g*, as shown in FIG. 6(*a*), passage of the paper 7 (one or two sheets) cannot be recognized.

FIG. 6(*b*) is a diagram of a differential electric signal outputted by differentiating the analog value of the electric signal outputted by the Hall element 62 by the differentiation circuit 64. FIG. 6(*c*) is a diagram of an integral electric signal outputted by integrating the differential electric signal, outputted by the differentiation circuit 64, by the integration circuit 65.

According to FIG. 6(*b*), the passage of the paper 7 (one or two sheets) cannot be recognized because of a noise caused by a power source circuit. However, in this embodiment, by integrating the differential electric signal by the integration circuit 65, the noise caused by the power source circuit can be canceled. Accordingly, by detecting a peak value in FIG. 6(*c*), timing of IN of the paper 7 (one or two sheets) (a moment at which the front end of the paper 7 (one or two sheets) reaches below the contact part 21 of the arm 20) and timing of OUT of the paper 7 (one or two sheets) (a moment at which the rear end of the paper 7 (one or two sheets) is separated from below the contact part 21 of the arm 20) can be detected. Since the peak value is changed according to whether the number of the sheet of the paper 7 is one or two, that is, the peak value of the case of the two sheets of the paper 7 is larger than the peak value of the case of the one sheet of the paper 7, whether the number of the sheet of the paper 7 is one or plurality can be distinguished.

As the above, the multi-feed detection device 100 according to this embodiment outputs the differential electric signal corresponding to the differential value of the electric signal outputted by the Hall element 62, and outputs the integral electric signal corresponding to the integral value of the differential electric signal. Accordingly, in comparison with a conventional multi-feed detection device, whether "the paper 7 which is conveyed along the conveyance path 2*g* toward the conveying direction set previously" is "the one sheet of the paper 7" or "the plurality of (two or more) overlapped sheets of the paper 7" can be detected accurately.

In this embodiment, the strength of the magnetic field acting to the magnetic sensor can be changed more widely than the conventional multi-feed detection device without enlarging the arm member and the like or using a permanent magnet which can generate a stronger magnetic field, whereby the device can be miniaturized and production cost can be reduced.

In the body side control device 2*c*, a program judging whether "the paper 7 which is conveyed along the conveyance path 2*g* toward the conveying direction set previously" is "the one sheet of the paper 7" or "the plurality of (two or more) overlapped sheets of the paper 7" on the basis of the electric signal outputted by the multi-feed detection device 100 (the output voltage of the multi-feed detection device 100) (multi-feed judgment program) is stored.

On the basis of the multi-feed judgment program, the body side control device 2*c* judges that "the one sheet of the paper 7 is conveyed along the conveyance path 2*g*" when the integral electric signal outputted by the multi-feed detection device 100 is not more than a predetermined threshold, and judges that "the plurality of (two or more) overlapped sheets of the paper 7 are conveyed along the conveyance path 2*g*"

when the integral electric signal outputted by the multi-feed detection device 100 is not less than the predetermined threshold.

The body side control device 2*c* controls the operation of each part of the composite machine 1 on the basis of the judgment result of the multi-feed judgment program (for example, the operation of the document reading device 2*b*, the printing device 2*d*, the paper supply device 2*e* and the conveyance path 2*g* are stopped and warning is displayed on the display device 2*h*).

Embodiment

An explanation will be given on first to third embodiments showing difference of the output signal caused by the state of the conveyed paper 7 in the multi-feed detection device 100 referring to FIGS. 7 to 9.

Figure 7:
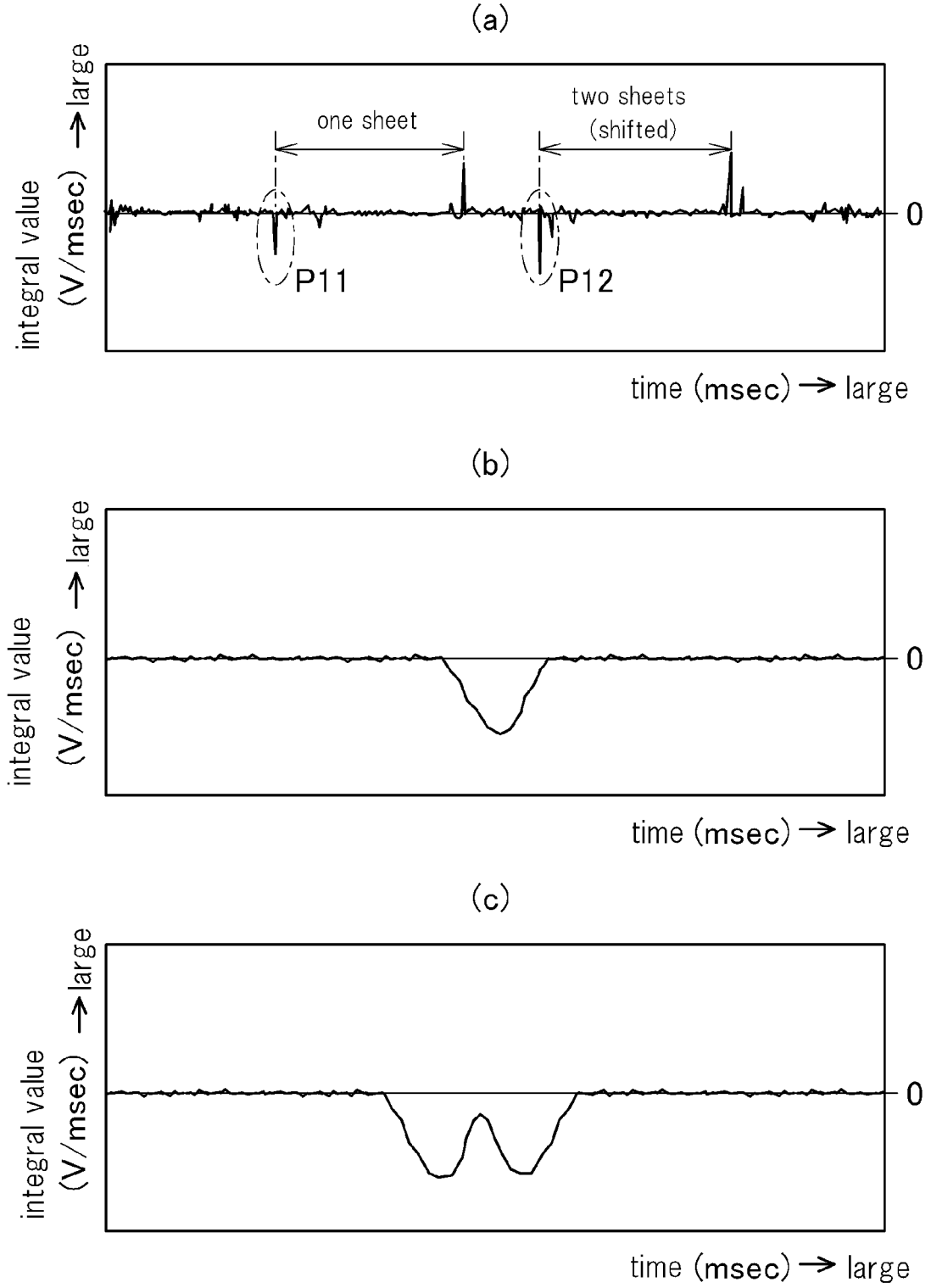
FIG. 7(*a*) is a diagram of a first embodiment of the integral electric signal outputted by the integration circuit in the multi-feed detection device, FIG. 7(*b*) is an enlarged diagram of a part P11 in a time axis of FIG. 7(*a*), and FIG. 7(*c*) is an enlarged diagram of a part P12 in the time axis of FIG. 7(*a*).

FIG. 7(*a*) to (*c*) shows the first embodiment of the integral electric signal outputted by the integration circuit in the multi-feed detection device. In this embodiment, the multi-feed detection device 100 detects "the one sheet of the paper 7 and the two sheets of the paper 7 which are overlapped while being shifted a little in the conveying direction". (a) is a diagram of the integral electric signal outputted by the integration circuit 65 in the multi-feed detection device 100, (b) is an enlarged diagram of a part P11 in a time axis of (a), and (c) is an enlarged diagram of a part P12 in the time axis of (a).

As shown in FIG. 7(*a*), in this embodiment, in the case of either the one sheet of the paper 7 or the two shifted sheets of the paper 7, the smaller peak of the integral value (the parts P11 and P12) is obtained at the moment at which the front end of the paper 7 reaches below the contact part 21 of the arm 20 (the timing of IN), whereby the conveyance of the paper 7 (one or two sheets) below the multi-feed detection device 100 can be detected. The larger peak of the integral value is obtained at the moment at which the rear end of the paper 7 is separated from below the contact part 21 of the arm 20 (the timing of OUT), whereby the taking out of the paper 7 (one or two sheets) from below the multi-feed detection device 100 can be detected.

In this embodiment, as shown in FIGS. 7(*b*) and (*c*), the one peak of the integral value is obtained when the one sheet of the paper 7 is conveyed to below the multi-feed detection device 100, and the two peaks of the integral value is obtained when the two shifted sheets of the paper 7 are conveyed to below the multi-feed detection device 100. Namely, by the multi-feed detection device 100 according to this embodiment, whether the paper 7 (one or two sheets) is shifted or not can be judged by judging whether the number of the peak of the integral value is one or the plurality.

Figure 8:
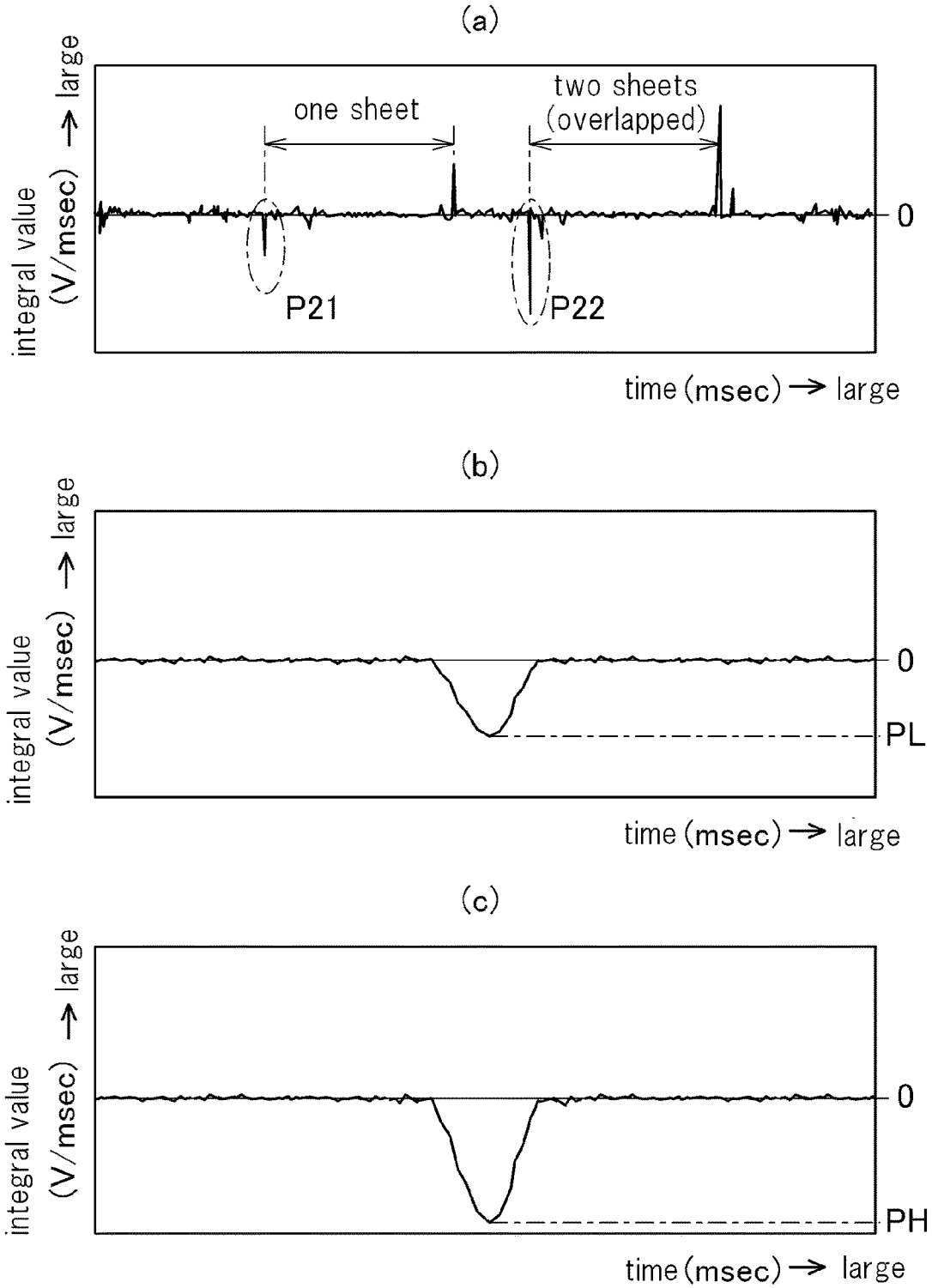
FIG. 8(*a*) is a diagram of a second embodiment of the integral electric signal outputted by the integration circuit in the multi-feed detection device, FIG. 8(*b*) is an enlarged diagram of a part P21 in a time axis of FIG. 8(*a*), and FIG. 8(*c*) is an enlarged diagram of a part P22 in the time axis of FIG. 8(*a*).

FIGS. 8(*a*) to (*c*) shows the second embodiment of the integral electric signal outputted by the integration circuit in the multi-feed detection device. In this embodiment, the multi-feed detection device 100 detects "the one sheet of the paper 7 and the two sheets of the paper 7 which are overlapped while not being shifted in the conveying direction". (a) is a diagram of the integral electric signal outputted by the integration circuit 65 in the multi-feed detection device 100, (b) is an enlarged diagram of the part P11 in a time axis of (a), and (c) is an enlarged diagram of the part P12 in the time axis of (a).

As shown in FIG. 8(*a*), in this embodiment, similarly to the first embodiment, in the case of either the one sheet of the paper 7 or the two sheets of the paper 7 which are not shifted, the smaller peak of the integral value (the parts P21 and P22) is obtained at the moment at which the front end of the paper 7 reaches below the contact part 21 of the arm 20 (the timing of IN), whereby the conveyance of the paper 7 (one or two sheets) below the multi-feed detection device 100 can be detected. The larger peak of the integral value is obtained at the moment at which the rear end of the paper 7 is separated from below the contact part 21 of the arm 20 (the timing of OUT), whereby the taking out of the paper 7 (one or two sheets) from below the multi-feed detection device 100 can be detected.

In this embodiment, as shown in FIGS. 8(*b*) and (*c*), the peak value PL of the integral value is relatively small when the one sheet of the paper 7 is conveyed to below the multi-feed detection device 100, and the peak value PH of the integral value is relatively large when the two sheets of the paper 7 which are not shifted are conveyed to below the multi-feed detection device 100. Namely, by the multi-feed detection device 100 according to this embodiment, whether the two or more sheets of the paper 7 are overlapped without being shifted or not can be judged by setting a predetermined threshold between the peak value PL and the peak value PH and judging whether the peak value of the integral value is larger than the predetermined threshold or not.

Figure 9:
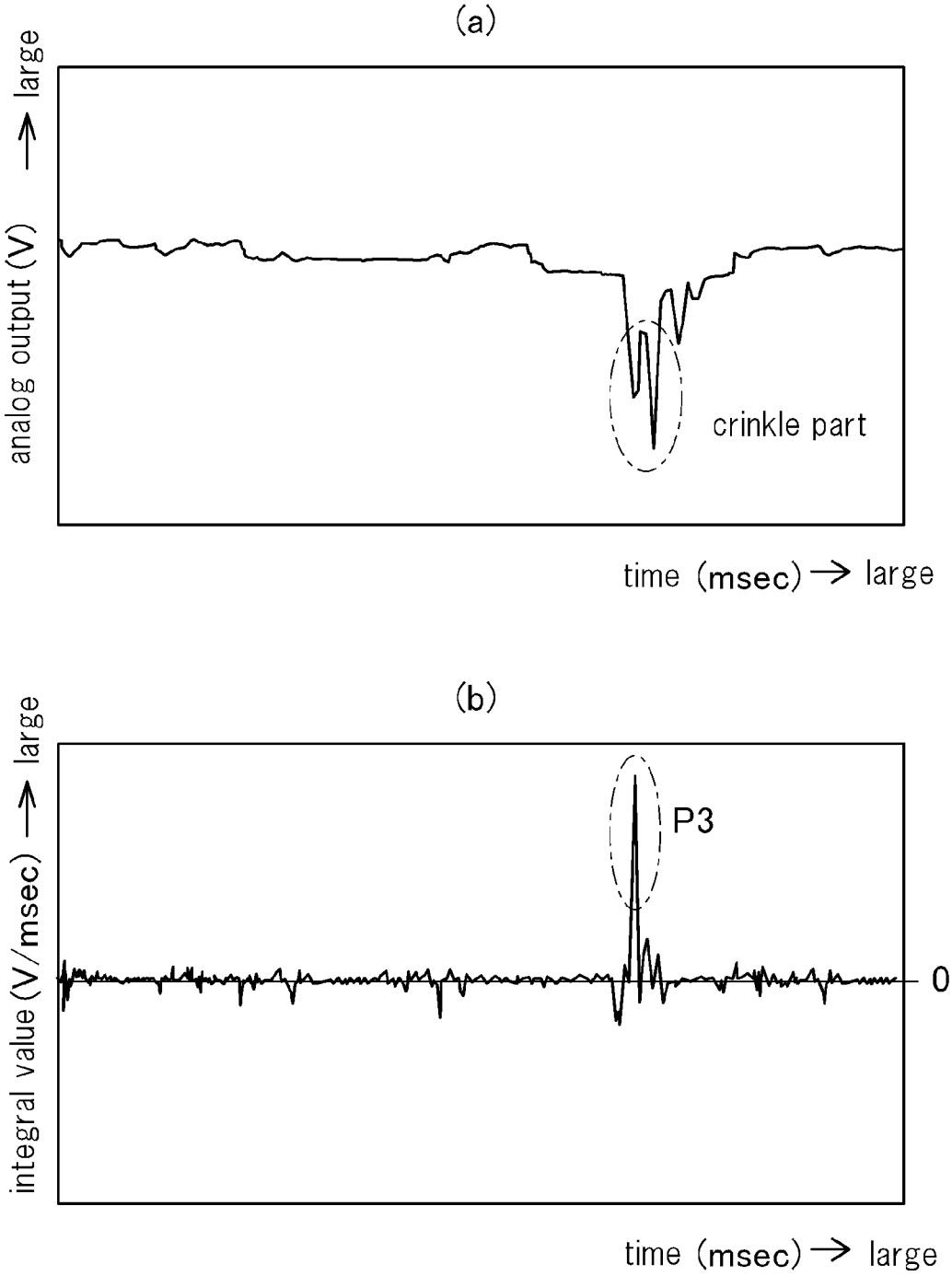
FIG. 9(*a*) is a diagram of the analog value of the electric signal outputted by the magnetic sensor according to a third embodiment, and FIG. 9(*b*) is a diagram of the integral electric signal outputted by the integration circuit according to a third embodiment.

FIGS. 9(*a*) and (*b*) shows the third embodiment of the integral electric signal outputted by the integration circuit in the multi-feed detection device. In this embodiment, the multi-feed detection device 100 detects "the crinkled paper 7". (a) is a diagram of the analog value of the electric signal outputted by the Hall element 62 of the multi-feed detection device 100 in this embodiment, and (b) is a diagram of the integral electric signal outputted by the integration circuit 65 in this embodiment.

In this embodiment, in the case in which the paper 7 is crinkled, both the peak of the analogue value of the electric signal outputted by the Hall element 62 shown in FIG. 9(*a*) and the peak of the integral electric signal outputted by the integration circuit 65 shown in FIG. 9(*b*) are obtained (a part P3 in FIG. 9(*b*)), whereby the crinkle generated in the paper 7 can be detected. Namely, by the multi-feed detection device 100 according to this embodiment, whether the paper 7 is crinkled or not can be judged by judging whether a predetermined peak value is obtained at a predetermined length of the paper 7 (between the timing of IN and the timing of OUT).

Though the contact part 21 in this embodiment contacts "the upper sheet surface of the pair of the upper and lower sheet surfaces of the paper 7", the present invention is not limited thereto. Namely, the contact part 21 of the multi-feed detection device 100 according to the present invention may touch "one of the pair of the upper and lower sheet surfaces of the sheet-shaped object".

Though the upper end of the magnet 32 is the N pole and the lower end thereof is the S pole in this embodiment, the present invention is not limited thereto. The magnet 32 may be arranged so that the upper end thereof is the S pole and the lower end thereof is the N pole. In other words, in the present invention, the magnetic flux line may be generated from the magnet 32 toward the Hall element 62.

Though the magnet 32 is moved so as to be separated from the Hall element 62 (upward) when the arm 20 is rotated along the separating direction (counterclockwise when viewed in right side) in this embodiment, the present invention is not limited thereto.

Namely, the magnet 32 may be moved so as to approach the Hall element 62 when the arm 20 is rotated counterclockwise when viewed in right side.

In this embodiment, the direction of the movement of the magnet 32 at the time of the rotation of the arm 20 (the vertical direction) is in parallel to the direction of the magnetic flux line of the magnetic field generated by the magnet 32 (the upward direction).

According to the configuration, "change value of the magnetic flux density of the magnetic field generated on the magnet 32" corresponding to "movement distance of the magnet 32" is increased, whereby measurement accuracy of the multi-feed detection device 100 is improved.

In the present invention, the description "the direction of the movement of the magnet at the time of the rotation of the arm member is in parallel to the direction of the magnetic flux line of the magnetic field generated by the magnet" includes not only the case that the direction of the movement of the magnet is completely in parallel to the direction of the magnetic flux line of the magnet (an angle between them is zero) but also the case that the angle between "the direction of the movement of the magnet" and "the direction of the magnetic flux line of the magnet" is not zero in such a range as not to deteriorate remarkably working effect of the present invention.

Though the spring 33 is the coil spring made by the metal material in this embodiment, the present invention is not limited thereto. Namely, instead of the spring 33, the main body part 22 and the arm 20 may be biased by a coil spring made by a resin material, a leaf spring made by a resin or metal material, a massive member made by an elastically deformable material (for example, rubber), a spongy resin material formed massively or the like. By adjusting weight balance of the arm 20 and using empty weight of the arm 20 as the biasing force, the spring 33 may be omitted.

At the view point of followability of the contact part concerning the sheet surface of the sheet-shaped object (maintenance of the state that the contact part contacts the sheet surface of the sheet-shaped object when the sheet-shaped object passes through the detection position), preferably, the arm member is biased by a member which can generate biasing force as this embodiment.

In such a range as not to deteriorate remarkably the working effect of the present invention, the axial direction of the rotation shafts 23 may not be in parallel to the conveying surface of the conveyance path 2*g*, and the axial direction of the rotation shafts 23 may not be perpendicular to the conveying direction.

However, at the view point for keeping the measurement accuracy of the multi-feed detection device 100 high (in detail, for smoothening the rotation of the arm 20 and improving durability of the arm 20 and the base 10 supporting rotatably the arm 20), preferably, the axial direction of the rotation shafts 23 of the arm 20 (lateral direction) is in parallel to the conveying surface (the surface perpendicular to the vertical direction) of the conveyance path 2*g*, and the axial direction of the rotation shafts 23 is perpendicular to the conveying direction (longitudinal direction) as this embodiment.

INDUSTRIAL APPLICABILITY

The multi-feed detection device according to the present invention can improve the measurement accuracy without remarkable enlargement and increase of cost in comparison with the conventional art, thereby being useful industrially.

The invention claimed is:

1. A multi-feed detection device which judges whether a sheet-shaped-object, which has a pair of sheet surfaces and is conveyed along a conveyance path toward a conveying direction set previously, is one object or a plurality of overlapped objects, comprising:

a base member fixed to a detection position which is in a middle part of the conveyance path and is opposite to the sheet-shaped object conveyed along the conveyance path;

an arm member which has a contact part contacting one of the sheet surfaces of the sheet-shaped object conveyed along the conveyance path, is supported rotatably by the base member, and is applied thereto with biasing force so as to be rotated for making the contact part approach the conveyance path, wherein the contact part contacts the one of the sheet surfaces of the sheet-shaped object conveyed along the conveyance path so that the arm member is rotated so as to make the contact part approach or be separated from the conveyance path oppositely to the biasing force;

a magnet fixed to the arm member and moved following the rotation of the arm member;

a magnetic sensor which is fixed to a position opposite to the magnet in the base member and outputs an electric signal corresponding to a magnetic field changed by the movement of the magnet;

a differentiation circuit which is connected to the magnetic sensor and outputs a differential electric signal corresponding to a differential value of the electric signal outputted by the magnetic sensor; and an integration circuit which is connected to the differentiation circuit and outputs an integral electric signal corresponding to an integral value of the differential electric signal outputted by the differentiation circuit, wherein the arm member has a bar-like upper part having a front end and a rear end, a bar-like lower part having a front end and a rear end, wherein the front end of the bar-like lower part is connected with the front end of the bar-like upper part, and an arc part which connects rear ends of the upper part and the lower part to each other, and the arm member has a circular part which is a fan-like shape when viewed in an axial direction of a rotation shaft of the arm member connected to the base member, a corner formed by the bar-like upper part and the bar-like lower part is formed at an acute angle in a rotation center of the fan-like shape and rotatably supported by the base member, one of ends of an arc part of the fan-like shape is formed as the contact part, and the magnet is fixed to the other end of the arc part of the fan-like shape.

2. The multi-feed detection device according to claim 1, wherein a direction of the movement of the magnet at the time of the rotation of the arm member is in parallel to a direction of a magnetic flux line of the magnetic field generated on the magnet.

3. The multi-feed detection device according to claim 1, wherein when the base member is fixed to the detection position, an axial direction of the rotation shaft of the arm member connected to the base member is perpendicular to the conveying direction, and is in parallel to the pair of the sheet surfaces of the sheet-shaped-object conveyed along the conveyance path.

4. The multi-feed detection device according to claim 2, wherein when the base member is fixed to the detection position, an axial direction of the rotation shaft of the arm member connected to the base member is perpendicular to the conveying direction, and is in parallel to the pair of the sheet surfaces of the sheet-shaped-object conveyed along the conveyance path.

5. A sheet-shaped-object handling device having the multi-feed detection device according to claim 1.

6. A sheet-shaped-object handling device having the multi-feed detection device according to claim 2.

7. A sheet-shaped-object handling device having the multi-feed detection device according to claim 3.

* * * * *